US006015157A

United States Patent [19]

Hilgarth

[11] Patent Number: 6,015,157

[45] Date of Patent: Jan. 18, 2000

[54] ROLLER SKATE ADAPTABLE TO USER, STYLE, AND TERRAIN

[75] Inventor: Kurt Hilgarth, Graz-Sciersberg, Austria

[73] Assignee: Fancyform Design Engineering, Graz-Grambach, Austria

[21] Appl. No.: 08/831,082

[22] Filed: Apr. 1, 1997

[30] Foreign Application Priority Data

| | | | |
|---|---|---|---|
| Apr. 1, 1996 | [AT] | Austria | 183/96 U |
| Sep. 20, 1996 | [IT] | Italy | UD96A0177 |
| Dec. 20, 1996 | [IT] | Italy | UD96A0246 |

[51] Int. Cl.[7] ..... A63C 1/00

[52] U.S. Cl. ..... 280/11.27

[58] Field of Search ..... 280/11.2, 11.22, 280/11.23, 11.27, 11.28, 239

[56] References Cited

U.S. PATENT DOCUMENTS

| | | | |
|---|---|---|---|
| 480,610 | 8/1892 | Nielson | 280/11.22 |
| 1,260,692 | 3/1918 | Madsen | 280/11.22 |
| 1,530,211 | 3/1925 | Siemnash | 280/11.22 |
| 1,868,548 | 7/1932 | Turner | 280/11.2 |
| 5,046,746 | 9/1991 | Gierveld | 280/11.2 |
| 5,190,301 | 3/1993 | Malewicz . | |
| 5,452,907 | 9/1995 | Meibock et al. | 280/11.2 |
| 5,551,712 | 9/1996 | Repucci | 280/11.2 |
| 5,575,489 | 11/1996 | Oyen et al. | 280/11.22 |
| 5,586,777 | 12/1996 | Wolf | 280/11.2 |
| 5,735,537 | 4/1998 | Zorzi | 280/11.2 |
| 5,772,220 | 6/1998 | Gaster | 280/11.22 |

FOREIGN PATENT DOCUMENTS

| | | |
|---|---|---|
| 0 469 639 | 5/1992 | European Pat. Off. . |
| 2 942 969 | 7/1981 | Germany . |

*Primary Examiner*—Peter M. Poon
*Assistant Examiner*—Charles R Ducker, Jr.
*Attorney, Agent, or Firm*—Jacobson, Price, Holman & Stern, PLLC

[57] ABSTRACT

Roller skate comprising the body of a shoe (11) wherein the skater's foot and part of the leg are housed, associated with a support (12) on which the skating elements (13) are mounted, there being included at least a front skating element (13*a*), a middle skating element (13*b*) and a rear skating element (13*c*), the roller skate in that the shoe (11) being constrained to the support (12) at least by means of an articulated oscillation connection (19) and cooperating with the support (12) by means of a guide element (18), the skating elements (13) having a diameter of between 90 and 120 mm and the support (12) including assembly seatings for the skating elements (13) defining a first position where the skating elements (13) are substantially aligned, and a second position of vertical limit where at least the front skating element (13*a*) is in a raised position with respect to the skating surface (20), by a value at least one sixth of the diameter of the middle skating elements (13*b*) and in any case not less than 15 mm from the skating surface (20).

18 Claims, 4 Drawing Sheets

ROLLER SKATE ADAPTABLE TO USER, STYLE, AND TERRAIN

This invention concerns a roller skate consisting of a shoe and a support for skating elements such as wheels or otherwise as set forth in the main claim.

With reference to the invention, the terms roller skate and skate with aligned wheels must be understood in the widest sense of the words and therefore including all kinds of embodiments of footwear suitable for skating or sliding on any kind of surface; this context therefore includes roller skates which have their wheels arranged transversely, and roller skates which have their wheels aligned, and other particular types of skate.

Roller skates known to the state of the art consist substantially of a shoe and skating elements such as wheels or other elements associated with a support attached to the shoe by means of attachment means such as screws, rivets or similar means.

The shoe may be of the rigid type, consisting of a plastic casing associated directly with the support, or of the semi-rigid type, consisting of a substantially flexible shoe or boot associated with a rigid understructure constrained to the support.

In both cases, the rigid connection between the shoe and the support for the skating elements limits the skating action as it does not allow the skater to adequately transmit to the skate the full force of the articulated thrusting movements he makes.

Moreover, the rigid connection of the shoe to the support does not allow—or at least makes difficult—the use of a single shoe for different types of support, and thus the user is obliged to purchase the two components of the skate for the various circumstances.

Other embodiments known to the state of the art associate the support for the skating elements with shoes of a substantially common type, by means of straps or other similar auxiliary means.

However, this kind of embodiment, although the constraint has a certain elasticity, does not give sufficient stability to the combined shoe-support and does not give enough support to the skater's ankle.

And users complain that it is impossible to adjust the arrangement and/or configuration of this type of skate.

In fact, skates known to the state of the art do not include this type of adjustment, and therefore it is not possible to adequately adjust the skate according to the physical characteristics of the skater, the skater's style of skating and the type of terrain where the skating will take place.

Some embodiments have proposed a system to adjust the position of the skating elements which includes a pair of slots arranged on the two sides of the support for each of the skating elements.

In this embodiment, the pin of the skating element can be positioned when so desired inside the slots and thus clamped to the support.

However, this clamping is not very efficient, as the stresses to which the skate is subjected can cause the pin to come loose and therefore it can be displaced inside the slot.

In order to increase the efficiency of this clamping action, in some embodiments (U.S. Pat. No. 5,046,746, DE-A-29 42 969) knurled washers are included between the head of the pin and the support, cooperating with mating knurled surfaces made on the two sides of the support itself.

Although this solution makes the clamping action more stable, it does not prevent the pin being displaced inside the slot when there are strong vibrations or stresses caused by particularly uneven skating surfaces, nor does it assist a correct alignment of the skating elements.

Another solution, as shown for example in EP-A-0 469 639 or U.S. Pat. No. 5,190,301, has plugs inserted inside the slots which have an eccentric hole inside which the pin of the skating elements is housed.

It is possible to vary the position of the skating elements by rotating the plugs by 180° in such a way as to cause the eccentric hole to be displaced with respect to the slots and therefore with respect to the support.

However, this solution only allows two choices of position for each skating element, and thus considerably limits the range of configurations which the skate is capable of.

Moreover, the fact that the skating elements are interchangeable, and that their assembly position can be varied, means that their assembly on the relative support is not easy.

To be more exact, it is necessary to hold in position the elements which clamp the bearings, whether they be spacers, washers or otherwise, while the pin is inserted into the relative housing seating.

It is particularly difficult to hold these clamping elements given the narrow spaces available.

Some embodiments include the use of bearings of a special type where the inner ring protrudes more than the mating outer ring.

With this solution it is possible to hold the bearing without the need for spacers, since the inner ring is clamped onto the wing of the support, while the outer ring is free to rotate.

However, this makes it necessary to include slots of a considerable size between the wings of the support and the skating elements, inside which dust or other dirt may be deposited, and in the long term this may compromise the efficiency of the skating elements.

Moreover, by using bearings of a special type, and also spacers or other similar elements, the cost of production of the wheels—and therefore of the skate itself—is increased.

Another problem which users complain of is that there is no shock absorber system able to make the skating more comfortable and smooth by absorbing the stresses transmitted by the skating elements to the shoe and caused mainly by the uneven surface on which the activity is performed.

Particularly significant factors for a correct and efficient skating action, especially on off-road tracks, are: the ability to vary the arrangement and configuration of the skate, the skate's ability to absorb shocks, the skater's stability and support for the skater's ankle.

In fact, off-road tracks are particularly uneven as there are breaks in the surface which stress the skater's ankles and more generally legs, moreover impeding the thrusting action performed by the skater.

Moreover, because of the conformation of skates known to the state of the art, the skater has to face the irregularities of the track with the first skating element knocking against the obstacle placed in front of it.

The first skating element or front portion thereof, as they are positioned at the front or in correspondence with the front of the foot, do not usually carry the main weight of the skater, are less in contact with the ground and therefore less stable.

Very often therefore, the impact causes the skater to lose his balance, in proportion to the size of the obstacle he has to face, and also causes him to slow down.

When the obstacle is particularly large, moreover, the skate may run into the obstacle, thus causing a "lever" effect which normally causes the skater to fall.

The present applicants have designed, tested and embodied this invention to overcome the shortcomings of the state of the art and to achieve further advantages.

This invention is set forth and characterised in the main claim, while the dependent claims describe variants of the idea of the main embodiment.

The purpose of the invention is to provide a skate which has a high degree of stability and allows an efficient skating action regardless of the type of surface on which it is used.

Another purpose of the invention is to provide a skate which can be adapted to any type of skating and which incorporates safety, comfort and high quality performance without being expensive and complex in structure.

Another purpose of the invention is to provide a skate which makes it possible to adopt a plurality of configurations and arrangements according to the skater's physical characteristics and skating style, the skating technique used and the type of track and surface on which the skate is used.

Another purpose of the invention is to equip the skate with a system to assemble and adjust the skating elements on the relative support which is quick, simple and inexpensive, securely constraining the parts together even when the stresses to which the skate is subject are extreme.

A further purpose of the invention is to provide a skate where the combined shoe-support can be inter-changed by means of a speedy and easy manual operation.

The skate according to the invention includes a connection of the articulated type between the shoe and the support at a desired point, and at least one guide element between the shoe and the support.

This type of articulated connection and the mating guide element ensure optimum skating conditions, as the shoe and the support are not rigidly constrained to each other and can therefore adapt to the movement of the skater and the surface of the terrain.

According to the invention, by adopting removable connection means it is possible to associate different types of support to the same shoe; it is therefore not necessary to have a different shoe for each skating activity, it is sufficient to purchase the suitable supports for each activity.

This is particularly advantageous considering that roller skating requires many variants of skate in terms of the arrangement and/or number of skating elements, according to the technique and the particular type of skating.

According to a variant, the reciprocal longitudinal positioning of the shoe and the support can be varied as the support includes a plurality of connection seatings mating with a plurality of constraint seatings on the guide element.

In this embodiment the shoe can be associated in different positions, further forward or less forward, with respect to the support, and thus gives a further diversification of the configurations of the skate, according to the requirements of use.

According to the invention, a particularly advantageous skating action is obtained by making the articulated connection of the shoe and support at the front part of the sole of the shoe, and by placing the mating guide element at the rear part of the sole.

To be more exact, the best results are obtained when the articulated connection is placed in the front third of the sole and the guide element placed in the rear third of the sole.

In this way the movements of the foot and the leg condition the sliding action of the support more efficiently, and this in fact gives a smoother and more efficient skating action.

In one embodiment of the invention, the shoe includes below the sole at least one extension with a hole on a substantially horizontal axis cooperating with a mating hole made on the support.

According to this embodiment the articulated connection of the shoe and the support is obtained by positioning the support in close proximity to this extension in such a way as to bring the relative holes into alignment and then inserting a pin-type constraining element into the holes.

In this way, apart from obtaining the desired oscillation between the support and the shoe, the support itself can be replaced simply and quickly.

According to another embodiment, at least one guide element arranged between the support and the shoe cooperates with shock absorber means, such as for example a spring or other functionally similar component.

With this solution the skating conditions are further improved, also as far as comfort is concerned, as the forward movement becomes particularly elastic.

According to a variant of the invention, by acting on the articulated connection, the guide element and/or the shock absorber means, it is possible to vary the angle of the sole of the shoe with respect to the support in such a way as to optimize the conditions of the skating action according to the skater's body weight, centre of gravity, and skating style.

In the skate according to the invention, particularly in its configuration for off-road tracks, the skating elements are associated or can be associated with the relative support in such a way that the front skating element and/or the rear skating element are in a raised position with respect to a theoretical horizontal skating plane, while at the same time the middle skating elements are resting on this theoretical plane.

This condition under which the skating elements are in contact with the ground makes it easier to overcome any possible obstacle which the skater might find on his path, and the skater can thus pass over the obstacle with the front part of the skate and then confront the obstacle with the middle part of the skate in a condition of greater stability.

According to the invention, the skating elements have a diameter of between 90 and 120 mm, and advantageously between 100 and 110 mm.

According to a first embodiment of the invention, the skating elements are associated with a support which puts them into an arched conformation.

According to a further embodiment, the support is arch-shaped, which substantially prevents the support from rubbing against the surface of the track, regardless of the position of the skating elements with respect to the support.

According to another embodiment of the invention, the front skating element and/or the rear skating element can be removed from the relative support, as they can be associated with their own assembly seatings made on the support at different heights with respect to a theoretical horizontal skating plane.

According to the invention, these different assembly seatings consist of specific and different holes to house the relative rotation pin for each of the skating elements.

The section of the housing holes is substantially mating with the section of the pin; the housing holes are made on the vertical wings of the support of the skate.

In one embodiment of the invention, for each of the skating elements, front and/or rear, at least a first of the assembly seatings is located at a height which is substantially equivalent to that of the middle skating elements and at least a second assembly seating is located at a greater height than the first.

This makes it possible to choose between a first configuration of the skate where the lower edge of each of the skating elements is substantially aligned with the others and a second configuration of the same skate where the front and/or rear skating element are assembled at the required maximum upper level with respect to the other skating elements.

According to the invention, between the first and second configuration there are several possible intermediate configurations.

According to the invention, in the second configuration the front or rear skating element is normally raised above the ground by at least a sixth of the diameter of the middle skating elements and in any case not less than 15 mm, advantageously 18÷25 mm.

According to the type of skating track, the skater can therefore choose between one configuration or the other, and position the skating elements in the most suitable manner.

According to a variant, the middle skating elements can also be removed, and include several assembly seatings located advantageously at the same height, but at different distances from the front and rear skating elements.

With this embodiment it is possible to vary the position at which the skater discharges the force of thrust onto the ground according to the type of track, the skating speed and other factors.

By using holes as assembly seatings of a section similar to that of the pins, the skating elements are constrained to the support in a particularly stable and secure manner, regardless of the conditions which the skate is used in; it also substantially prevents any translation of the pin.

Moreover, this system does not need any auxiliary elements to define the assembly seatings or to clamp the skating elements onto the support. Assembly operations are therefore easier and quicker and costs are reduced.

According to the invention, in correspondence with each housing hole there is at least a groove, made on the inner side of the corresponding wing of the support, to connect with the outer ring of the bearing of the skating element.

The groove allows the outer ring of the bearing to rotate without interference, while the inner ring is held in position by the contact between the wing of the support and the assembly pin.

In this way, there is no need to use bearings of a special type or spacers or other elements with a similar function in order to clamp the inner ring; the slot between the wings of the support and the skating elements is reduced to a minimum and thus allows a greater protection of the bearings from infiltrations or other.

The grooves make the operations of positioning the skating elements easier, and substantially allow the skating elements to be automatically centered.

With these characteristics, the system to assemble and adjust the skating elements is particularly simple and economical, quick and safe regardless of the conditions the skate is used in.

According to another embodiment of the invention, the skate includes a ventilation system for the shoe, comprising inlet apertures at the front where the air goes in and outlet apertures at the side where the air comes out; these apertures are able to create a circulation of the air while the skate is being used, so that the heat and humidity is discharged from inside the shoe.

The attached figures are given as a non-restrictive example and show some preferred embodiments of the invention as follows:

FIG. 1 shows a skate according to the invention in a first embodiment;

FIG. 1*a* shows a skate according to the invention in another embodiment;

Figure 5A:
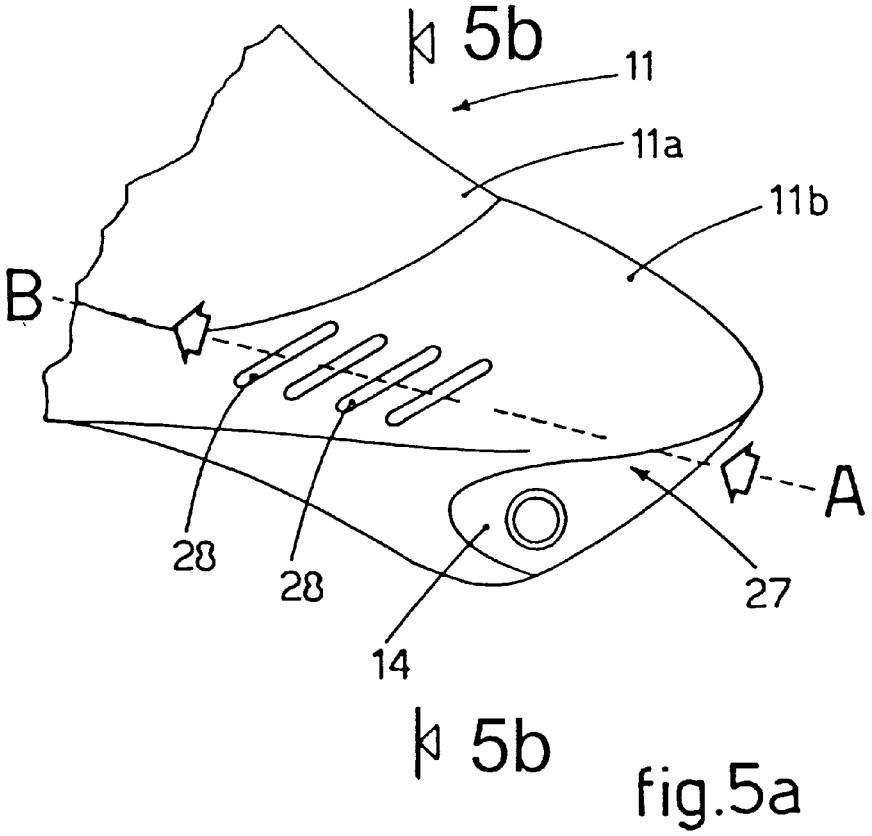
Figure 5B:
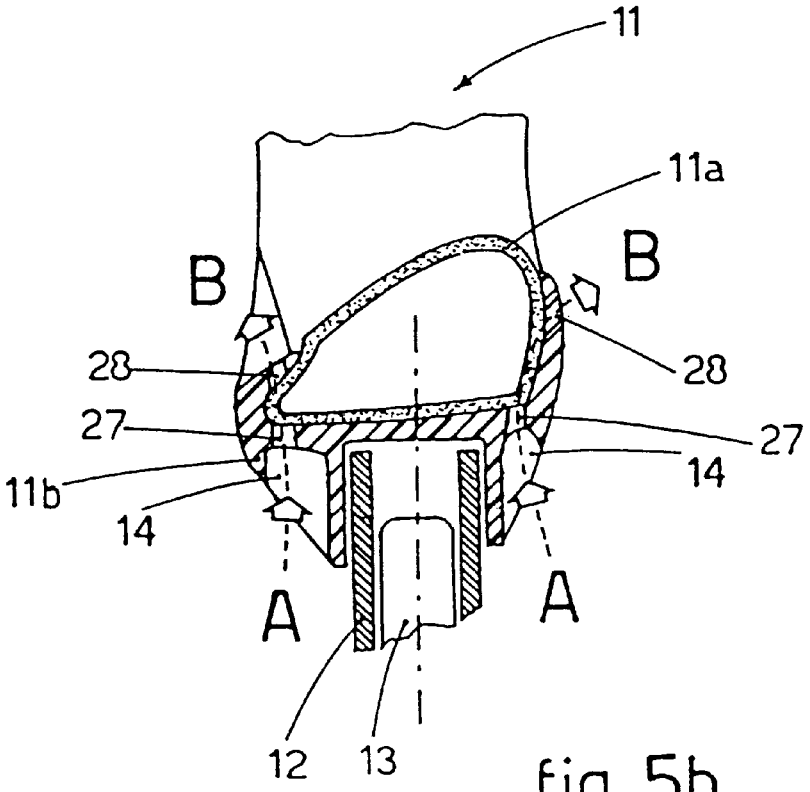

FIGS. 5*a* and 5*b* show a ventilation system for the skate

Figure 6:
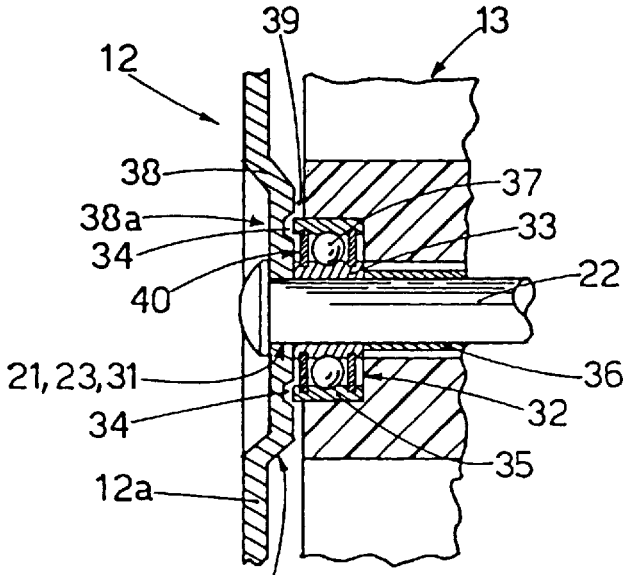
Figure 7:
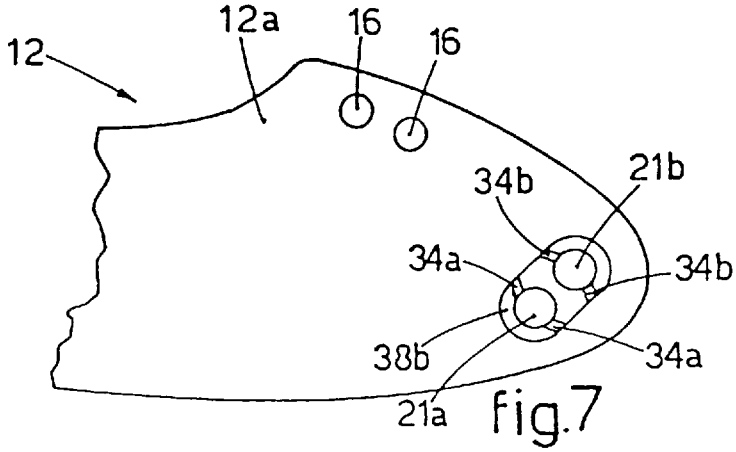

FIG. 6 shows a section of a detail of the system to assemble the skating elements of the skate according to the invention;

FIG. 7 shows a partial view from the inner side of a support of the skating elements of the skate according to the invention.

With reference to the attached figures the number 10 denotes generally a skate of the type with aligned wheels.

The skate 10 substantially comprises a shoe 11 associated with a support 12 on which the skating elements 13 are mounted, the skating elements in this case consisting of three wheels, respectively the front wheel 13*a*, the middle wheel 13*b* and the rear wheel 13*c*.

According to the invention, there can also be four or more skating elements 13.

The shoe 11 of the skate 10 shown consists of a boot or shoe component shoe component 11*a* made of a substantially flexible material which is inserted and anchored into an understructure 11*b* made of rigid material, the boot/shoe component 11*a* and the understructure 11*b* being able to be dissociated from each other, or constrained, or able to be constrained, to each other.

There is also a calf-part 11*c* made of semi-rigid material and oscillating at 11*d* with respect to the understructure 11*b* which serves both to reinforce and contain the ankle, and also to support the user's calf at the rear.

The calf-part 11*c* has an inner padding 11*e*, which serves to contain the leg and ankle better, and closing and clamping means 11*f*.

The connection 19 between the shoe 11 and the support 12 is of the articulated type and is advantageously made in correspondence with the front part of the shoe 11 itself.

In this case the articulated connection 19 is achieved by including, at the lower part of the front portion of the understructure 11*b*, two lateral extensions 14, each of which has a through hole 15 with a substantially horizontal axis, aligned with a through hole 16 made on the upper front part of the support 12.

The constraint between the shoe 11 and support 12 is obtained by inserting pin-type connection means 17 inside the holes 15, 16, which allows a reciprocal oscillation with respect to the pin-type connection means of the shoe 11 and the support 12, the pin-type connection means 17 including means to inhibit any axial displacement.

At the lower part of the rear portion of the understructure 11*b*, the skate 10 includes a guide element 18 cooperating with the support 12.

The guide element 18 constitutes a second constraint point between the shoe 11 and the support 12 cooperating with the articulated connection 19.

The articulated connection 19 of the skate 10 therefore makes it possible to obtain better and more comfortable skating conditions, regardless of the type of skating activity for which the skate is used.

According to an embodiment of the invention which is not shown here, the articulated connection 19 can be made in correspondence with the middle portion of the shoe 11, there being guide elements 18 in correspondence with the front and rear portions thereof.

Figure 2:
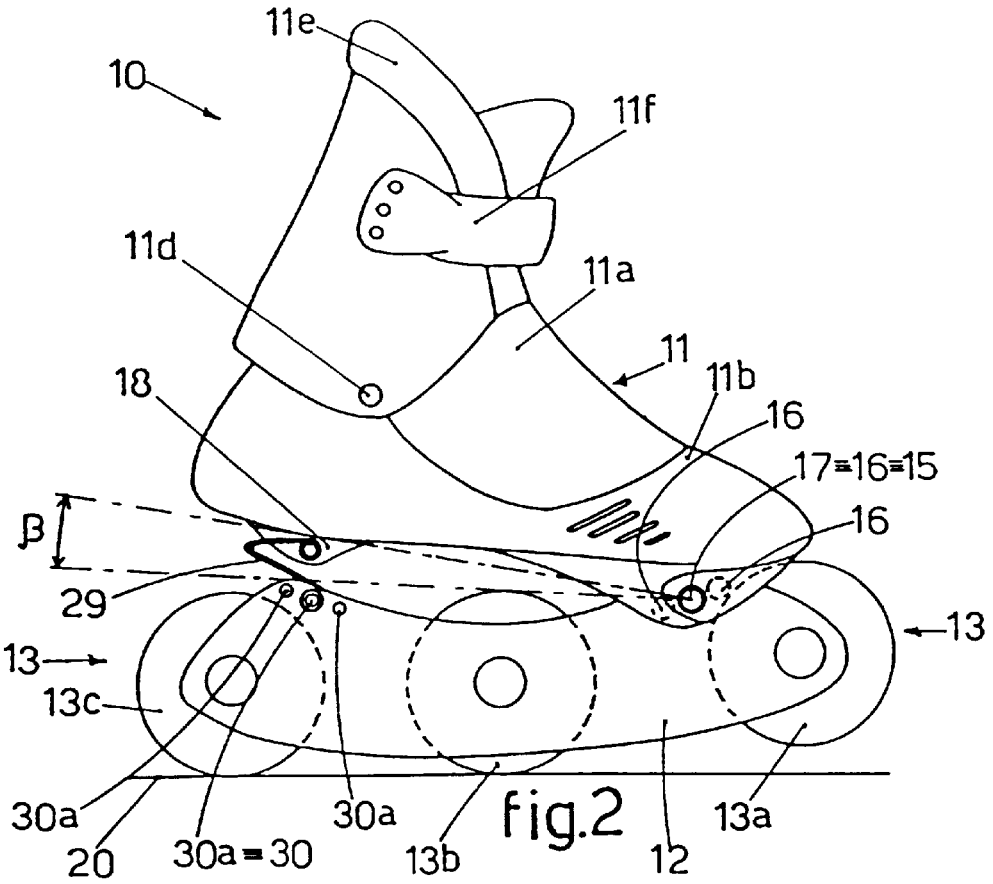
FIG. 2 shows the skate from FIG. 1 according to a variant of the invention.
Figure 3:
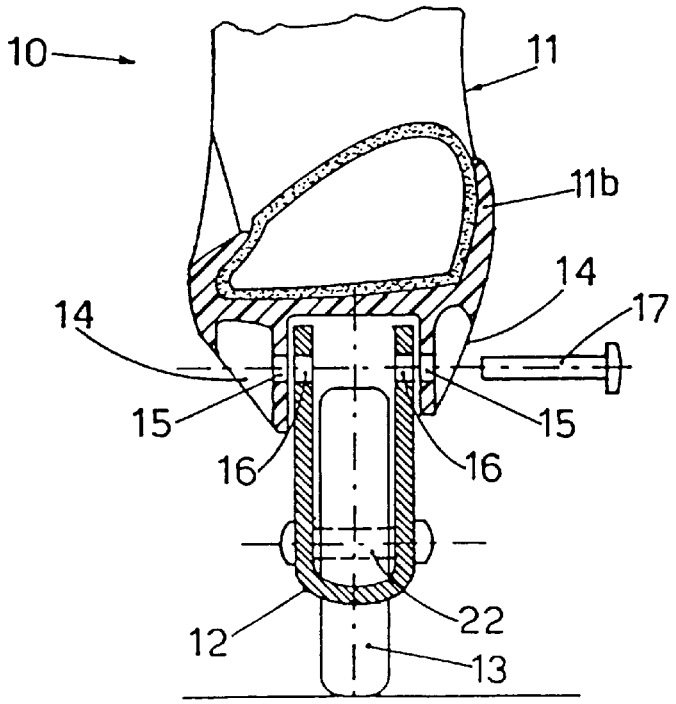
FIG. 3 shows in part section the skate with a connection system.

According to a variant of the invention shown in FIGS. 2 and 3, the support 12 can be dissociated from the shoe 11 by including pin-type connection means 17 of the kind which can be removed; in this way, it is possible to use a single shoe 11 for several different types of skating, as the shoe 11 can be associated with mating supports 12 of a different type.

Figure 1:
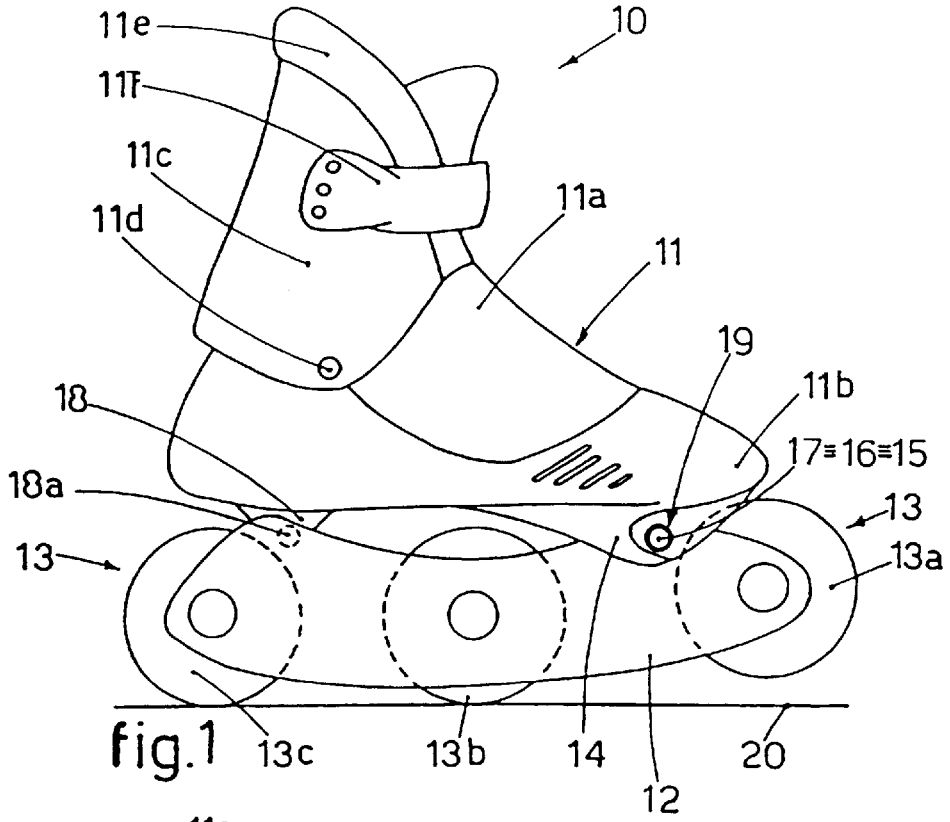
Figure 1A:
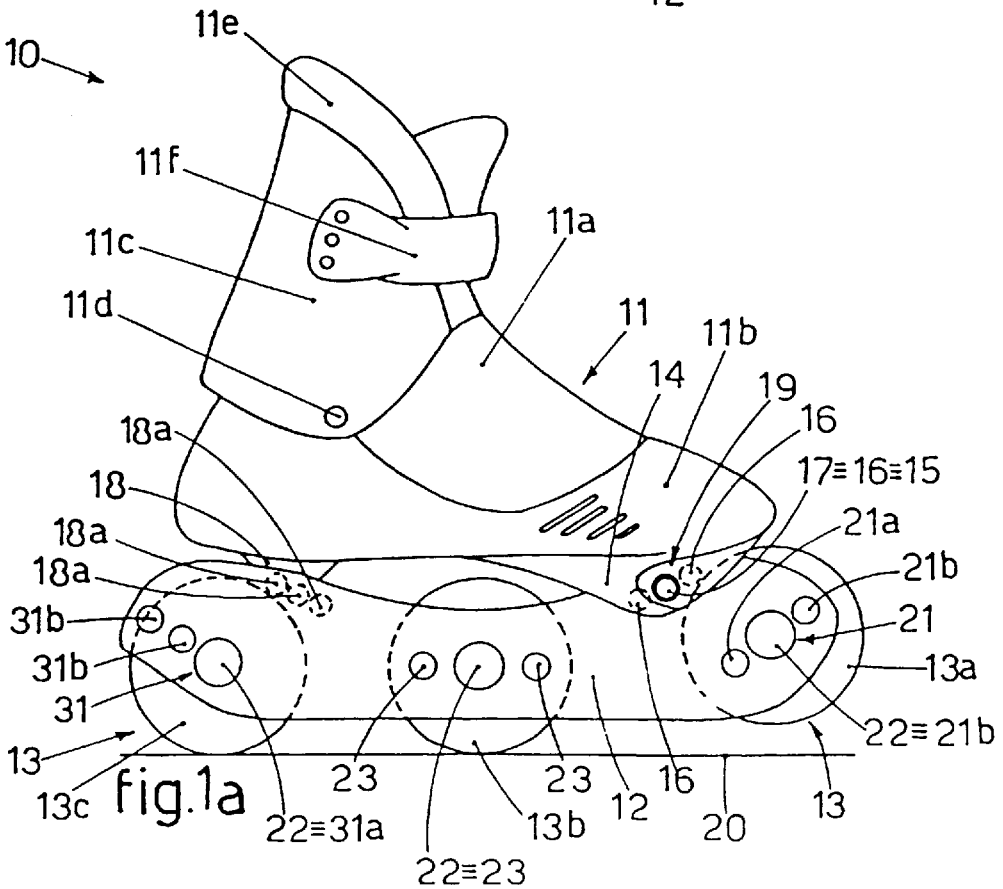

According to another variant shown in FIG. 1*a*, the shoe 11 can be associated in a more or less farther forward position with respect to the support 12, as the support 12 includes several holes 16 into which the pin-type connection means 17 can be inserted, and also several constraint seatings 18*a* on the guide element 18.

This embodiment makes it possible to obtain a first range of different configurations of the skate 10; the appropriate configuration is chosen by the skater according to the requirements of the particular use.

In the embodiment shown in FIGS. 2 and 6, a guide element 18 is included which cooperates with shock absorber means 29.

Figure 4:
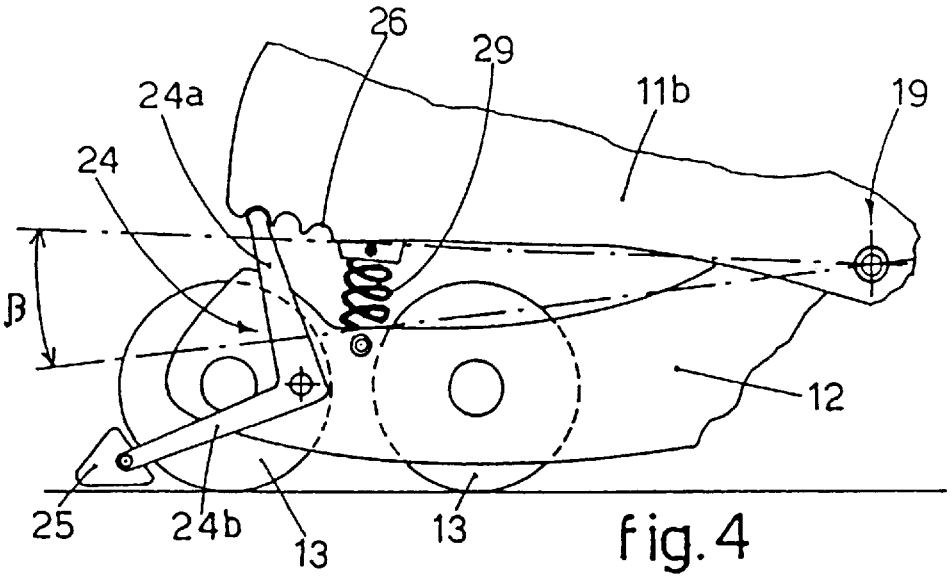
FIG. 4 shows the rear part of a skate according to a variant of the invention.

In FIG. 4, the shock absorber means 29 consist of a spring, while in FIG. 2 the shock absorber means 29 consist of an elastic blade, but it is possible to include any other shock absorber element which is similar in function, such as for example a bush made of elastic material, a gas shock absorber or other suitable means.

The shock absorber means 29 shown in FIG. 2 are of the removable type and can be constrained to/released from the support 12 by a plurality of anchoring seatings 30*a* by means of a relative oscillation pin 30.

By adjusting the pre-load of the shock absorber means 29 it is possible to vary the angle β of the sole of the understructure 11*b* with respect to the support 12, which makes it possible to obtain an optimum arrangement of the skate 10 according to the body weight and skating style of the user.

According to the invention, the angle β can be varied from 0 to 20° .

According to the invention, the horizontal plane of the skating means 13 has an angle of between 1° and 15° with respect to the median vertical plane of the shoe 11.

According to the invention the wheels 13 have a diameter of between 90 mm and 120 mm, advantageously between 100 mm and 110 mm.

According to the invention, the front wheel 13*a* and/or the rear wheel 13*c* are mounted on the support 12 at a greater height than that of the middle wheel 13*b* with respect to a theoretical horizontal skating plane 20, in such a way that they never rest on the theoretical plane 20 at the same time.

This allows the skate 10 to confront any type of surface, even one with considerable obstacles, and yet maintain substantially optimum skating conditions.

In a first embodiment of the invention as shown in FIG. 1, the wheels 13 are mounted attached to a support 12 shaped like an arch.

Any obstacle on the skating surface is thus overcome by the skater by raising the skate in a coordinated manner.

According to another embodiment shown in FIG. 1*a*, the support 12 includes a plurality of assembly seatings 21, 31 respectively for the front wheel 13*a* and the rear wheel 13*c*; the assembly seatings consist of housing holes, respectively 21, 31, made on the vertical wings 12*a* of the support 12.

The rotation pins 22 of the front wheel 13*a* and the rear wheel 13*c* are inserted into the housing holes 21, 31; the front and rear wheels 13*a*, 13*c* are of the type which can be mounted on/removed from the support 12 by means of the relative pin 22.

The housing holes 21, 31 are substantially equivalent in section to the pin 22, and are arranged at a height equal to or greater than the height at which the middle wheel 13*b* is assembled with respect to the theoretical skating plane 20.

In this case, both the front wheel 13*a* and the rear wheel 13*c* have a first assembly seating, respectively 21*a* and 31*a*, arranged substantially at the same height as the assembly seating of the middle wheel 13*b* which makes the three wheels level; in this condition, the skate 10 according to the invention can be used on flat surfaces without obstacles, as it assumes the normal configuration of conventional skates with aligned wheels.

However, when the skating surface has obstacles, the front wheel 13*a* and/or the rear wheel 13*c* are advantageously mounted in correspondence with the relative second seatings 21*b*, 31*b*, which are located at a greater height than that of the assembly seating 23 of the middle wheel 13*b*.

In the example shown in FIG. 1, the front wheel 13*a* is mounted in correspondence with its own second seating 21*b*, and is thus raised with respect to the middle wheel 13*b*, while the rear wheel 13*c* is mounted in correspondence with its own first seating 31*a*, and is thus level with respect to the middle wheel 13*b*.

According to a variant of the invention shown in FIG. 1*a*, the middle wheel 13*b* can also be mounted/removed by means of the relative pin 22 and can be associated with the support 12 in correspondence wih several assembly seatings 23 placed substantially at the same height, or at different heights, with respect to the theoretical horizontal skating plane.

This makes it possible to vary the conditions of the skate 10 according to the position assumed by the front wheel 13*a* and rear wheel 13*c*, and thus gives even greater versatility to the skate 10.

The specific housing holes 21, 23, 31 make it possible to obtain different configurations of the skate 10, yet maintain unchanged the stable constraint between the wheels 13 and the support 12, even when there are particularly uneven skating surfaces.

This is obtained without the need to use additional structural elements which make the operations to assemble the wheels 13 and the support 12 longer and more laborious.

FIGS. 6 and 7 show the clamping system for the bearings 32 of the wheels 13.

The inner ring 33 of each bearing 32 is clamped by the contact with the relative wing 12*a* of the support 12.

The wing 12*a*, on its inner side and in correspondence with each housing hole 21, 23, 31, includes at least a groove 34 mating with the outer ring 35 of the bearing 32 in such a way as to allow the outer ring 35 to rotate even when the inner ring 33 is in contact with the wing 12*a*.

In this way, while the inner ring 33 is kept clamped between the wing 12*a* and the spacer element 36, the outer ring 35, which protrudes sideways with respect to the containing cage 40 of the balls 37, can rotate freely with the wheel 13.

Thus it is possible to reduce to a minimum the interspace 39 between the wing 12*a* and the wheels 13 and therefore to protect the bearings 32 more.

In the case shown in FIGS. 6 and 7, the wings 12*a* include, in correspondence with the housing holes 21, 23, 31, a reinforcement 38 defining a depression 38*a* on the outer side of the wing 12*a* and a ridge 38*b* on the inner side of the wing 12*a*.

This reinforcement 38, apart from causing a stiffening of the wings 12*a*, also defines a niche to protect the head of the pin 22.

According to a variant shown in FIG. 4, the skate 10 has a braking system.

In this case the braking system is obtained by mounting an angled frame in correspondence with the rear part of the support 12. The angled frame 24 can be turned with respect to a substantially horizontal axis.

The angled frame 24 includes a first fin 24*a* constrained to the sole of the understructure 11*b* and a second fin 24*b* which has a braking element 25 at the end.

When the skate 10 is advancing normally, the angled frame 24 keeps the braking element 25 at a distance from the skating surface; when it is necessary to brake, the skater varies the pressure exerted by the heel on the shoe 11 and thus causes the angled frame 24 to rotate until it brings the braking element 25 into contact with the skating surface, which causes the skate to slow down.

In order to make the action of the braking system really correlated to the variation of the pressure of the heel on the shoe 11, a plurality of constraint seatings 26 may be included for the first fin 24*a* along the sole of the understructure 11*b*, in such a way that the braking system may be adapted to the body weight of the skater.

According to a further variant shown in FIGS. 5*a* and 5*b*, the skate 10 includes a system to ventilate the shoe 11.

In this case the ventilation system is obtained by including inlet apertures 27 at the front of the shoe 11 for the air to enter, and a plurality of outlet apertures 28 for the air to exit. The inlet apertures 27 are made in correspondence with the articulated connection 19, to be more exact, in correspondence with the lateral extensions 14. The outlet apertures 28 are made at the sides of the understructure 11*b* and are arranged parallel and sloping with respect to the perpendicular.

As the skate advances, the air passes through the inner part of the understructure 11*b* in a preferred direction A–B, from the apertures 27 to the apertures 28, thus removing the humidity and heat from the inner part of the understructure 11*b*.

I claim:

1. Roller skate comprising a body of a shoe (11) wherein a skater's foot and part of a leg are housed, associated with a support (12) on which skating elements (13) are mounted, there being included at least a front skating element (13*a*), a middle skating element (13*b*) and a rear skating element (13*c*), the roller skate being characterized in that the shoe (11) is constrained to the support (12) at least by means of an articulated oscillation connection (19) and cooperates with the support (12) by means of a guide element (18), the roller skate being further characterized in that the skating elements (13) have a diameter of between 90 and 120 mm and the support (12) includes assembly seatings for the skating elements (13) defining a first position where the skating elements (13) are substantially aligned, and a second position of vertical limit where at least the front skating element (13*a*) is in a raised position with respect to a skating surface (20), by a value at least one-sixth of the diameter of the middle skating elements (13*b*) and in any case not less than 15 mm from the skating surface (20), the roller skate being further characterized in that the assembly seatings for the front skating element (13*a*) consist of housing holes (21) for a relative rotation pin (22), the housing holes (21) having substantially the same section as the relative rotation pin (22).

2. Skate as in claim 1, in which the housing holes (21) are vertically positioned at various heights with respect to the skating surface (20).

3. Skate as in claim 1, in which the support (12) includes, on an inner side and in correspondence with each housing hole (21, 23, 31), grooves (34) for the positioning and centering of an outer ring (35) of a bearing (32) of the relative skating element (13).

4. Roller skate comprising a body of a shoe (11) wherein a skater's foot and part of a leg are housed, associated with a support (12) on which skating elements (13) are mounted, there being included at least a front skating element (13*a*), a middle skating element (13*b*) and a rear skating element (13*c*), the roller skate being characterized in that the shoe (11) is constrained to the support (12) at least by means of an articulated oscillation connection (19) and cooperates with the support (12) by means of a guide element (18), the roller skate being further characterized in that the skating elements (13) have a diameter of between 90 and 120 mm and the support (12) includes assembly seatings for the skating elements (13) defining a first position where the skating elements (13) are substantially aligned, and a second position of vertical limit where at least the front skating element (13*a*) is in a raised position with respect to a skating surface (20), by a value at least one-sixth of the diameter of the middle skating elements (13*b*) and in any case not less than 15 mm from the skating surface (20), the roller skate being further characterized in that the assembly seating of the rear skating element (13*c*) consist of housing holes (31) for a relative rotation pin (22), the housing holes (31) having substantially the same section as the relative rotation pin (22).

5. Skate as in claim 4, in which the housing holes (31) are vertically positioned at various heights with respect to the skating surface.

6. Roller skate comprising a body of a shoe (11) wherein a skater's foot and part of a leg are housed, associated with a support (12) on which skating elements (13) are mounted, there being included at least a front skating element (13*a*), a middle skating element (13*b*) and a rear skating element (13*c*), the roller skate being characterized in that the shoe (11) is constrained to the support (12) at least by means of an articulated oscillation connection (19) and cooperates with the support (12) by means of a guide element (18), the roller skate being further characterized in that the skating elements (13) have a diameter of between 90 and 120 mm and the support (12) includes assembly seatings for the skating elements (13) defining a first position where the skating elements (13) are substantially aligned, and a second position of vertical limit where at least the front skating element (13*a*) is in a raised position with respect to a skating surface (20), by a value at least one-sixth of the diameter of the middle skating elements (13*b*) and in any case not less than 15 mm from the skating surface (20), the roller skate being further characterized in that the support (12) includes, for every middle skating element (13*b*), at least two assembly seatings consisting of housing holes (23) with substantially the same section as that of a relative rotation pin (22), the housing holes (23) being arranged substantially lengthwise to the support (12).

7. Roller skate comprising a body of a shoe (11) wherein a skater's foot and part of a leg are housed, associated with a support (12) on which skating elements (13) are mounted, there being included at least a front skating element (13*a*), a middle skating element (13*b*) and a rear skating element (13*c*), the roller skate being characterized in that the shoe (11) is constrained to the support (12) at least by means of an articulated oscillation connection (19) and cooperates with the support (12) by means of a guide element (18), the roller skate being further characterized in that the skating elements (13) have a diameter of between 90 and 120 mm and the support (12) includes assembly seatings for the skating elements (13) defining a first position where the skating elements (13) are substantially aligned, and a second position of vertical limit where at least the front skating element (13*a*) is in a raised position with respect to a skating surface (20), by a value at least one-sixth of the diameter of the middle skating elements (13*b*) and in any case not less than 15 mm from the skating surface (20), the roller skate being further characterized in that between the guide element (18) and the support (12) there are shock absorber elements (29) removable by means of an oscillation pin (30), the shock absorber means (29) being anchored in at least a seating (30*a*) in the support (12).

8. Skate as in claim 7, in which there are at least two seatings (30*a*) where the shock absorber means (29) are anchored, arranged lengthwise to the support (12).

9. Skate as in claim 8, in which the shock absorber means (29) consist of an elastic foil.

10. Roller skate comprising a body of a shoe (11) wherein a skater's foot and part of a leg are housed, associated with a support (12) on which skating elements (13) are mounted, there being included at least a front skating element (13*a*), a middle skating element (13*b*) and a rear skating element (13*c*), the roller skate being characterized in that the shoe (11) is constrained to the support (12) at least by means of an articulated oscillation connection (19) and cooperates with the support (12) by means of a guide element (18), the roller skate being further characterized in that the skating elements (13) have a diameter of between 90 and 120 mm and the support (12) includes assembly seatings for the skating elements (13) defining a first position where the skating elements (13) are substantially aligned, and a second position of vertical limit where at least the front skating element (13*a*) is in a raised position with respect to a skating surface (20), by a value at least one-sixth of the diameter of the middle skating elements (13*b*) and in any case not less than 15 mm from the skating surface (20), the roller skate being further characterized in that the articulated connection (19) includes lateral extensions (14) with at least one through hole (15), the lateral extensions (14) cooperating with at least one through hole (16) in the support (12), the through holes (14, 15) cooperating with pin-type connection means (17) of the removable type.

11. Skate as in claim 10, in which the support (12) includes at least two through holes (16) arranged lengthwise.

12. Roller skate comprising a body of a shoe (11) wherein a skater's foot and part of a leg are housed, associated with a support (12) on which skating elements (13) are mounted, there being included at least a front skating element (13*a*), a middle skating element (13*b*) and a rear skating element (13*c*), the roller skate being characterized in that the shoe (11) is constrained to the support (12) at least by means of an articulated oscillation connection (19) and cooperates with the support (12) by means of a guide element (18), the roller skate being further characterized in that the skating elements (13) have a diameter of between 90 and 120 mm and the support (12) includes assembly seatings for the skating elements (13) defining a first position where the skating elements (13) are substantially aligned, and a second position of vertical limit where at least the front skating element (13*a*) is in a raised position with respect to a skating surface (20), by a value at least one-sixth of the diameter of the middle skating elements (13*b*) and in any case not less than 15 mm from the skating surface (20), the roller skate being further characterized in that the vertical plane on which the skating elements (13) lie has an angle of between 1° and 15° with respect to the median vertical plane of the shoe (11).

13. Roller skate comprising a body of a shoe (11) wherein a skater's foot and part of a leg are housed, associated with a support (12) on which skating elements (13) are mounted, there being included at least a front skating element (13*a*), a middle skating element (13*b*) and a rear skating element (13*c*), the roller skate being characterized in that the shoe (11) is constrained to the support (12) at least by means of an articulated oscillation connection (19) and cooperates with the support (12) by means of a guide element (18), the roller skate being further characterized in that the skating elements (13) have a diameter of between 90 and 120 mm and the support (12) includes assembly seatings for the skating elements (13) defining a first position where the skating elements (13) are substantially aligned, and a second position of vertical limit where at least the front skating element (13*a*) is in a raised position with respect to a skating surface (20), by a value at least one-sixth of the diameter of the middle skating elements (13*b*) and in any case not less than 15 mm from the skating surface (20), the roller skate being further characterized in that the sole of the shoe (11) includes an angle (β) with respect to the skating surface (20), this angle (β) being able to be adjusted from 0° to 20°.

14. Roller skate comprising a body of a shoe (11) wherein a skater's foot and part of a leg are housed, associated with a support (12) on which skating elements (13) are mounted, there being included at least a front skating element (13*a*), a middle skating element (13*b*) and a rear skating element (13*c*), the roller skate being characterized in that the shoe (11) is constrained to the support (12) at least by means of an articulated oscillation connection (19) and cooperates with the support (12) by means of a guide element (18), the roller skate being further characterized in that the skating elements (13) have a diameter of between 90 and 120 mm and the support (12) includes assembly seatings for the skating elements (13) defining a first position where the skating elements (13) are substantially aligned, and a second position of vertical limit where at least the front skating element (13*a*) is in a raised position with respect to a skating surface (20), by a value at least one-sixth of the diameter of the middle skating elements (13*b*) and in any case not less than 15 mm from the skating surface (20), the roller skate being further characterized in that there is a braking system comprising an angled frame (24) mounted so as to rotate around a substantially horizontal axis on the rear portion of the support (12), the angled frame (24) including a first fin (24*a*) constrained to a rear portion of the shoe (11) in correspondence with a skater's heel, and a second fin (24*b*) associated at an end to a braking element (25) which can be brought into contact with the skating surface.

15. Skate as in claim 14, in which the rotation of the angled frame (24), and therefore the condition of contact of the braking element (25) with the skating surface, is correlated to the pressure exerted by the skater's heel on the shoe (11).

16. Skate as in claim 14, in which the first fin (24*a*) can be positioned in correspondence with a plurality of constraint seatings (26) made lengthwise on the sole of the shoe (11).

17. Roller skate comprising a body of a shoe (11) wherein a skater's foot and part of a leg are housed, associated with a support (12) on which skating elements (13) are mounted, there being included at least a front skating element (13*a*), a middle skating element (13*b*) and a rear skating element (13*c*), the roller skate being characterized in that the shoe (11) is constrained to the support (12) at least by means of an articulated oscillation connection (19) and cooperates with the support (12) by means of a guide element (18), the roller skate being further characterized in that the skating elements (13) have a diameter of between 90 and 120 mm and the support (12) includes assembly seatings for the skating elements (13) defining a first position where the skating elements (13) are substantially aligned, and a second position of vertical limit where at least the front skating element **(13*a*) is in a raised position with respect to a skating surface (20), by a value at least one-sixth of the diameter of the middle skating elements (13*b*) and in any case not less than 15 mm from the skating surface (20), the roller skate being further characterized in that there is a ventilation system for the inner part of the shoe (11) comprising at least inlet apertures (27) at the front of the shoe (11) through which the air enters, made in correspondence with the front lower portion of the shoe (11), and outlet apertures (28) through which the air leaves, made in a desired lateral area of the shoe (11)**.

18. Skate as in claim 17, in which the inlet apertures (27) for the air are made on the sole of the shoe (11) in correspondence with the articulated connection (19) between the shoe (11) and the support (12).

* * * * *